US010881212B2

(12) United States Patent
Liu

(10) Patent No.: US 10,881,212 B2
(45) Date of Patent: Jan. 5, 2021

(54) CHAIR LINKING SYSTEM

(71) Applicant: Zhuhai Shichang Metals Ltd., Zhuhai (CN)

(72) Inventor: Jingbo Liu, Zhuhai (CN)

(73) Assignee: Zhuhai Shichang Metals Ltd., Zhuhai (CN)

( * ) Notice: Subject to any disclaimer, the term of this patent is extended or adjusted under 35 U.S.C. 154(b) by 246 days.

(21) Appl. No.: 16/250,154

(22) Filed: Jan. 17, 2019

(65) Prior Publication Data

US 2020/0229606 A1 Jul. 23, 2020

(51) Int. Cl.
*A47C 1/124* (2006.01)
*A47C 11/00* (2006.01)
*A47C 7/62* (2006.01)

(52) U.S. Cl.
CPC ..... *A47C 11/005* (2013.01); *A47C 1/124* (2013.01); *A47C 7/62* (2013.01)

(58) Field of Classification Search
CPC ..... A47C 1/124; A47C 11/005; A47C 7/62
USPC ..... 297/248
See application file for complete search history.

(56) References Cited

U.S. PATENT DOCUMENTS 942,085 A 12/1909 Linder
1,198,726 A * 9/1916 Huntley ..... A47C 1/124 297/248
1,934,396 A * 11/1933 Bales ..... A47C 1/124 297/248 X
2,751,969 A 6/1956 Jan
2,821,762 A * 2/1958 Foose ..... A47C 1/124 297/248 X
3,023,989 A * 3/1962 White ..... F16L 3/2235 248/68.1
3,095,237 A 6/1963 Desnoyers et al.
3,188,138 A * 6/1965 Lockshin ..... A47C 1/124 297/248
3,614,158 A 10/1971 Mohr
3,669,491 A * 6/1972 Weslock ..... A47C 1/124 297/248
3,758,155 A * 9/1973 Straits ..... A47C 3/04 297/248
3,825,300 A * 7/1974 Lieberman ..... A47C 1/124 297/248

(Continued)

FOREIGN PATENT DOCUMENTS

JP 08332125 A * 12/1996 ..... A47C 7/002

*Primary Examiner* — Rodney B White
(74) *Attorney, Agent, or Firm* — Luedeka Neely Group, P.C.

(57) ABSTRACT

A linking system for folding chairs and a method for linking folding chairs in rows. The linking system includes a first linking member having two spaced-apart, u-shaped first recesses on a first side thereof and a slit on each end thereof, wherein each slit is parallel to an axis defined by the u-shaped recesses; a second linking member having two spaced-apart, u-shaped second recesses on a second side thereof and two spaced-apart, u-shaped third recesses on a third side thereof, wherein the u-shaped third recesses are spaced further apart than the second recesses and the third side is orthogonal to the second side; and a third linking member having two spaced-apart, u-shaped fourth recesses on a fourth side thereof. The first, second and third linking members are configured to snappingly engage tubular members of adjacent folding chairs.

19 Claims, 6 Drawing Sheets

(56) References Cited

U.S. PATENT DOCUMENTS 3,894,706 A * 7/1975 Mizusawa ..... F16L 3/2235 248/68.1
4,224,721 A * 9/1980 Ohlson ..... F16B 7/0433 24/376
4,805,938 A * 2/1989 Redmond ..... F16B 2/065 297/248 X
4,978,168 A 12/1990 Piretti
5,129,703 A * 7/1992 Ballendat ..... A47C 1/124 297/248
5,282,669 A * 2/1994 Barile ..... A47C 3/04 297/248
5,542,159 A * 8/1996 Schultz ..... A47C 1/124 297/248 X
5,954,396 A * 9/1999 Kemnitzer ..... A47C 3/04 297/248
5,957,530 A 9/1999 Gutgsell
6,048,127 A * 4/2000 Kern ..... A47B 87/002 108/158
6,338,528 B1 * 1/2002 Lohness ..... A47C 1/124 297/248 X
6,749,259 B2 * 6/2004 Ware ..... A47C 1/124 297/248 X
7,806,474 B2 * 10/2010 Wahl ..... A47C 13/005 297/248
8,632,123 B2 * 1/2014 Barile ..... A47C 7/622 297/248 X
9,226,592 B2 * 1/2016 Lin ..... F16B 2/06
9,282,823 B2 * 3/2016 Kumazawa ..... A47C 1/124
9,713,382 B2 * 7/2017 Rogers ..... A47C 3/04
9,826,832 B2 * 11/2017 Lin ..... A47C 7/58
10,021,981 B1 * 7/2018 Zheng ..... A47C 1/124
10,021,986 B1 * 7/2018 Lin ..... A47C 1/124
10,349,746 B2 * 7/2019 Koehler ..... A47C 7/16
2005/0012371 A1 * 1/2005 Mendenhall ..... A47C 1/124 297/248
2014/0152059 A1 6/2014 Swy
2014/0175848 A1 6/2014 Motta
2015/0296986 A1 10/2015 Rogers

* cited by examiner

CHAIR LINKING SYSTEM

TECHNICAL FIELD

The disclosure relates a safety system for meeting rooms. More particularly, the disclosure is directed to a chair linking system for folding chairs that prevents a disarray of chairs in an emergency.

BACKGROUND AND SUMMARY

Chairs that can readily be attached to one another are typically used in multi-purpose rooms to provide a variety of different chair configurations and numbers of chairs in a row. Such chairs are suitably light in weight and have a configuration that enhances the ability of the chairs to be stacked on one another when not in use. In some situations, folding chairs are used for meeting purposes. Folding chairs can be folded and stored in a much more limited storage space.

In order to improve safety and provide uniform spacing and numbers of chairs in a row, ganging systems are typically used to interlock adjacent chairs to one another. A wide variety of interlocking or ganging devices are known and are attached in a variety of ways to the chairs. However, most ganging devices are permanently attached to non-foldable chairs and typically are not suitable for use with folding chairs.

When folding chairs are used in a meeting room or other assembly, the folding chairs are typically aligned with one another in rows to provide the widest array of seats available for the room. Unlike stackable non-folding chairs, folding chairs cannot be readily linked to one another. If an emergency arises and persons attending the meeting must move quickly from the room, the folding chairs may be pushed or collapsed by sudden movement or panic, thereby presenting a tripping hazard as people attempt to make their way to the room exits. In view of the foregoing, what is needed is a linking system for folding chairs that will significantly reduce the disarray of chairs when an emergency arises during a meeting.

In view of the foregoing, embodiments of the disclosure provide a linking system for folding chairs and a method for linking folding chairs in rows. The linking system includes a first linking member having two spaced-apart, u-shaped first recesses on a first side thereof and a slit on each end thereof; a second linking member having two spaced-apart, u-shaped second recesses on a second side thereof and two spaced-apart, u-shaped third recesses on a third side thereof, wherein the u-shaped third recesses are spaced further apart than the second recesses; and a third linking member having two spaced-apart, u-shaped fourth recesses on a fourth side thereof. The first, second and third linking members are configured to snappingly engage tubular members of adjacent folding chairs.

In one embodiment there is provided a method for linking folding chairs in rows. The method includes providing a linking system having a first linking member having two spaced-apart, u-shaped first recesses on a first side thereof and a slit on each end; a second linking member having two spaced-apart, u-shaped second recesses on a second side thereof and two spaced-apart, u-shaped third recesses on a third side thereof, wherein the u-shaped third recesses are spaced further apart than the second recesses; and a third linking member having two spaced-apart, u-shaped fourth recesses on a fourth side thereof. The first, second and third linking members are configured to snappingly engage tubular members of adjacent folding chairs. The linking system is attached to tubular members of adjacent folding chairs to provide a row of linked folding chairs.

In another embodiment there is provided a linking system for folding chairs. The linking system includes a first linking member having two spaced-apart, u-shaped first recesses on a first side thereof and a slit on each end thereof, wherein the first linking member is configured to snappingly engage lower front legs and cross-members of two adjacent folding chairs; a second linking member having two spaced-apart, u-shaped second recesses on a second side thereof; and two spaced-apart, u-shaped third recesses on a third side thereof, wherein the u-shaped third recesses are spaced further apart than the second recesses and the second linking member is configured to snappingly engage upper rear legs and back support members of the two adjacent folding chairs; and a third linking member having two spaced-apart, u-shaped fourth recesses on a fourth side thereof, wherein the third linking member is configured to snappingly engage lower rear legs of two adjacent folding chairs.

In some embodiments, the first linking member is configured to snappingly engage lower front legs and cross-members of two adjacent folding chairs.

In other embodiments, the second linking member is configured to snappingly engage upper rear legs and back support members of two adjacent folding chairs.

In some other embodiments, the third linking member is configured to snappingly engage lower rear legs of two adjacent folding chairs.

In still other embodiments, the first, second and third linking members are molded from a thermoplastic material.

In another embodiment the first, second and third linking members further comprise reinforcing webbing for strength.

In some embodiments, each slit in the first linking member is parallel to an axis defined by the u-shaped recesses.

In other embodiments, the third side of the second linking member is orthogonal to the second side.

An advantage of the linking system described herein is that the system provides a simple but robust method for attaching folding chairs in rows so that disarray of the chairs during an emergency does not create a tripping hazard. Surprisingly, and quite unexpectedly, the linking system is capable of preventing a row of eleven linked chairs from deforming more than 200 millimeters from an initial starting location when acted on by a 200 Newton force that is applied to the middle chair in the row of eleven chairs.

BRIEF DESCRIPTION OF THE DRAWINGS

Additional features and advantages of the disclosed embodiments will be apparent from the detailed description which follows, taken in conjunction with the accompanying drawings, which together illustrate, by way of example, features of the disclosed embodiments; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXEMPLARY EMBODIMENT(S)

Figure 1:
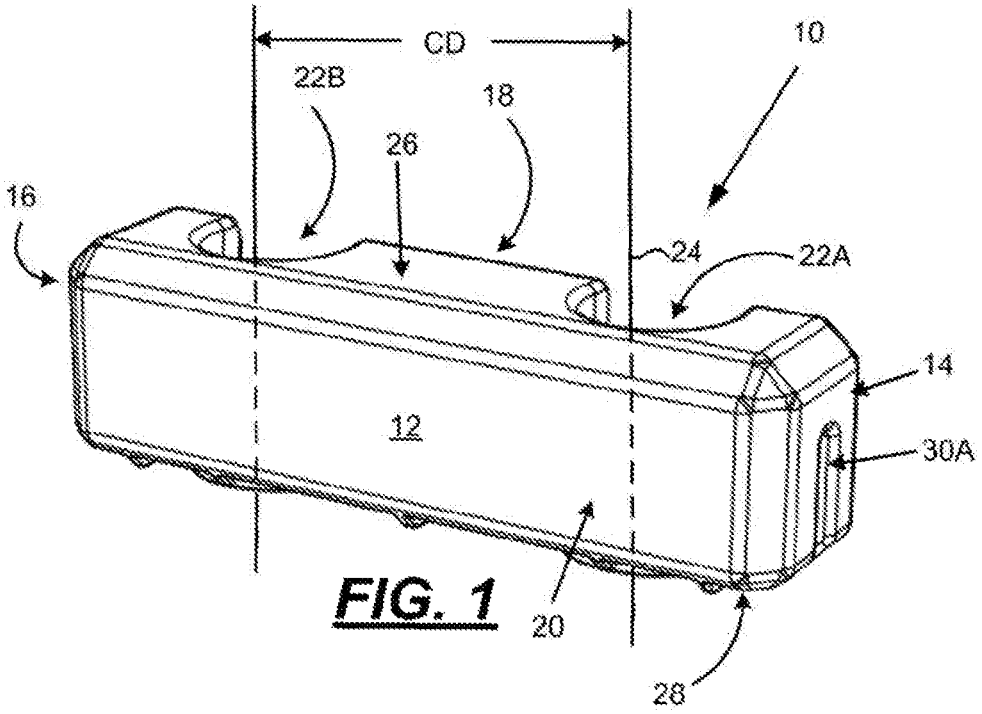
FIG. 1 is a perspective view, not to scale, of a first linking member according to an embodiment of the disclosure.
Figure 2:
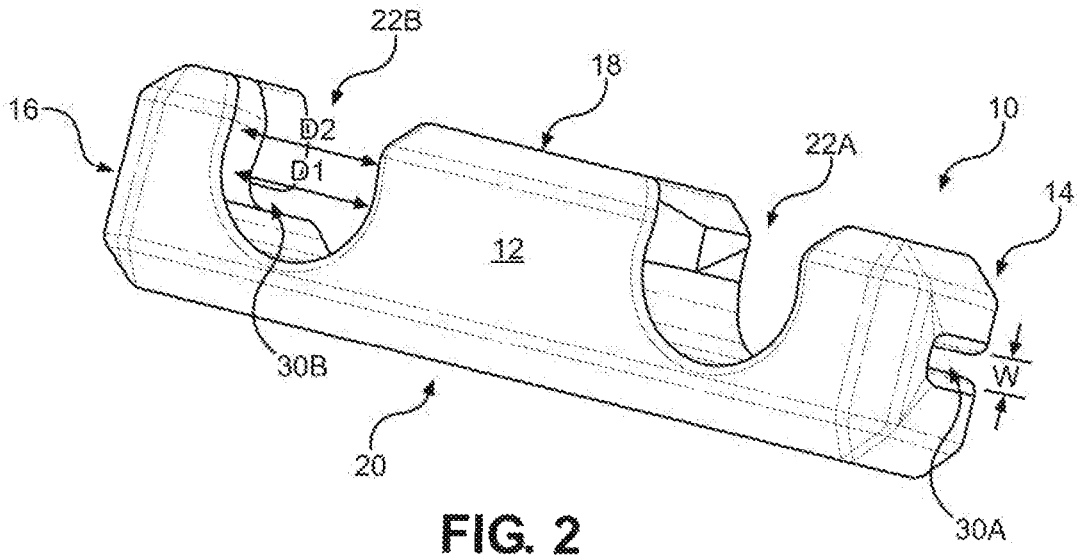
FIG. 2 is a rotated top perspective view, not to scale, of the first linking member of FIG. 1.
Figure 3:
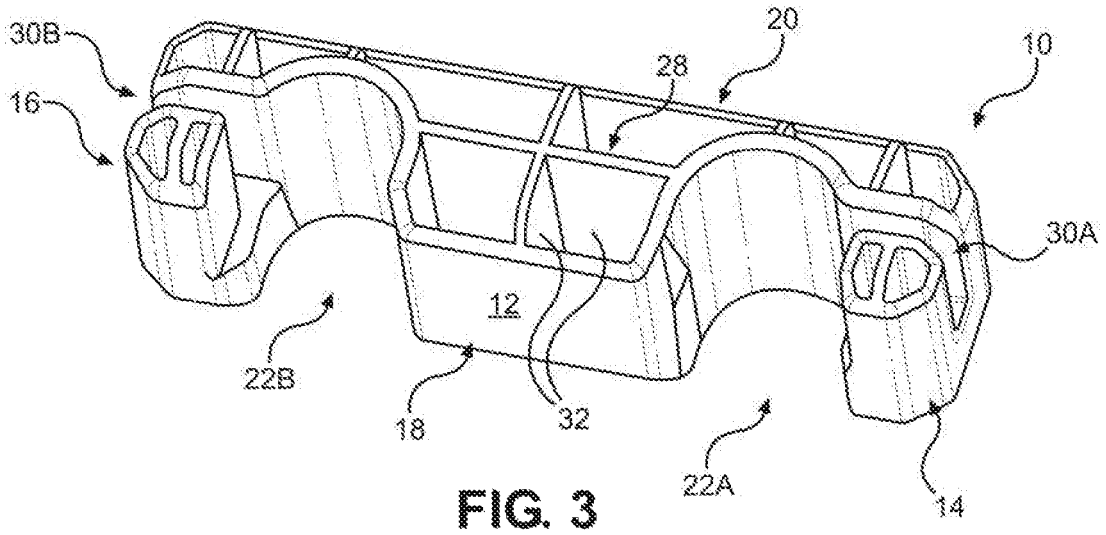
FIG. 3 is a rotated bottom perspective view, not to scale, of the first linking member of FIG. 1.
Figure 4:
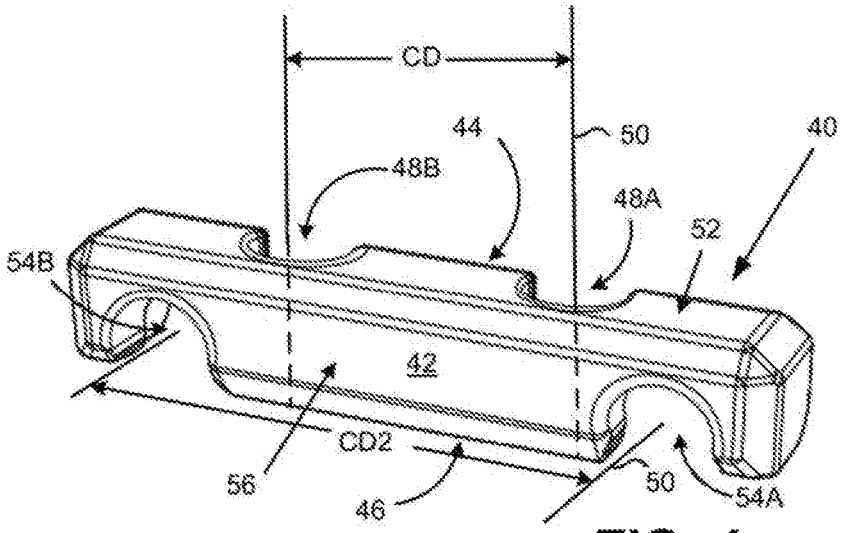
FIG. 4 is a perspective view, not to scale, of a second linking member according to an embodiment of the disclosure.
Figure 5:
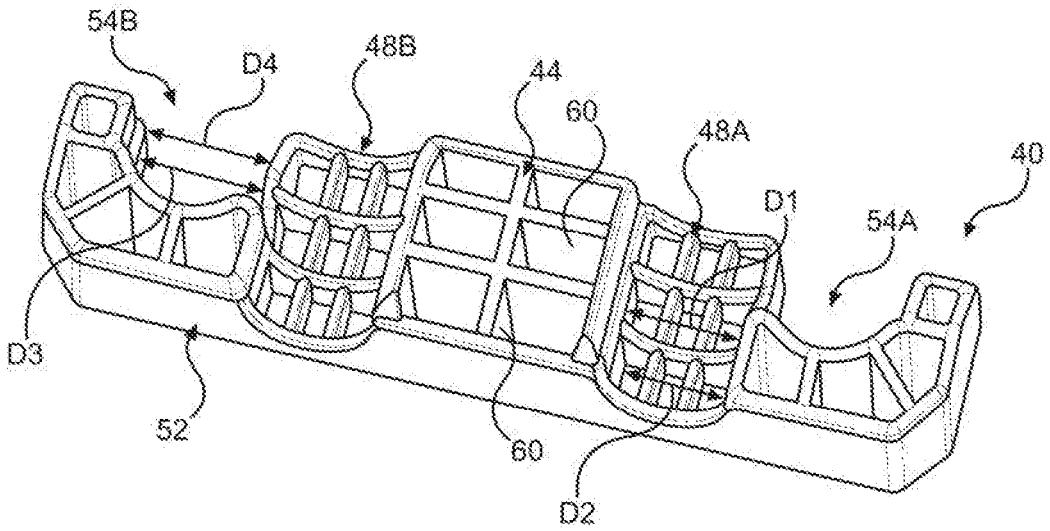
FIG. 5 is a rotated bottom perspective view, not to scale, of the second linking member of FIG. 4.
Figure 6:
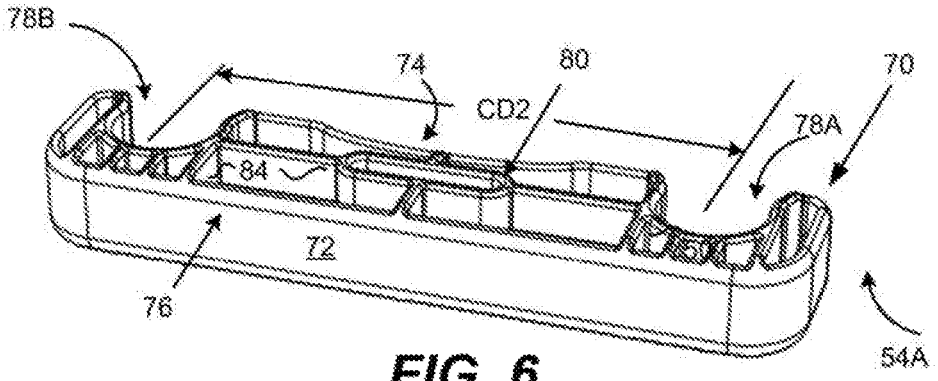
FIG. 6 is a perspective view, not to scale, of a third linking member according to an embodiment of the disclosure.
Figure 7:
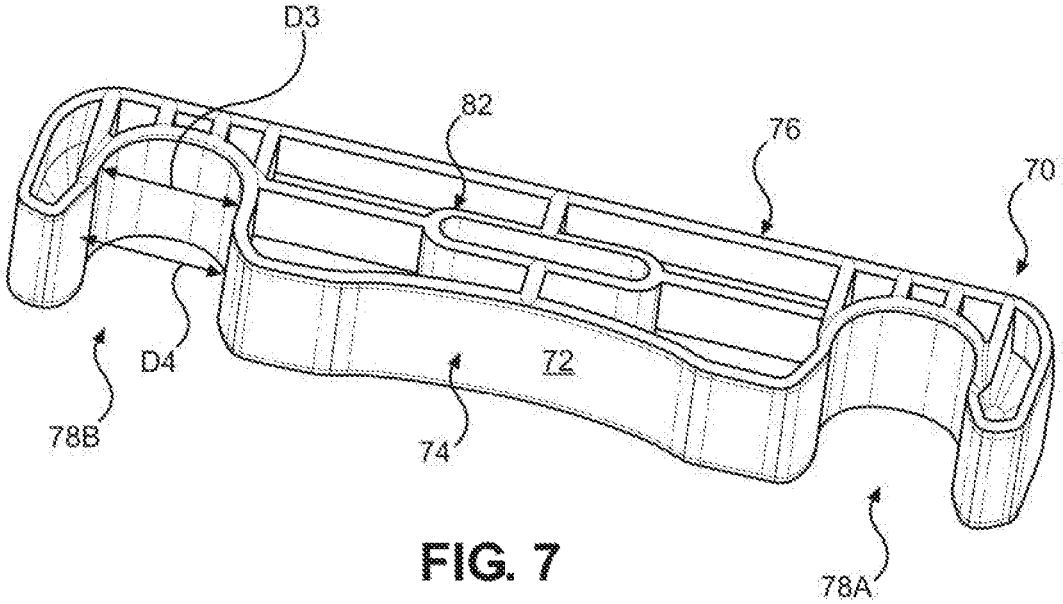
FIG. 7 is a rotated bottom perspective view, not to scale, of the third linking member of FIG. 6.
Figure 8:
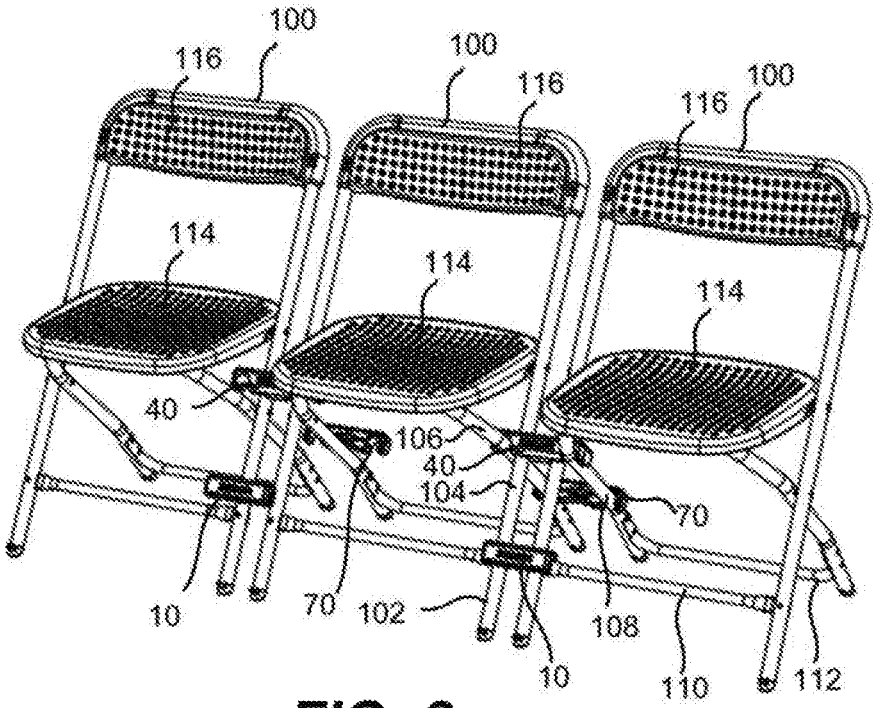
FIG. 8 is a perspective view, not to scale, of folding chairs and the linking system according to the disclosure.

As set forth above, the linking system according to the disclosure includes three linking members. The first linking member 10 is illustrated in FIGS. 1-3. The second linking member 40 is illustrated in FIGS. 4-5 and the third linking member 70 is illustrated in FIGS. 6-7.

With reference now to FIGS. 1-3, the first linking member 10 has a generally rectangular prism-shaped body 12 having a first end 14, a second end 16, a first side 18 and a second side 20. A pair of spaced-apart, u-shaped recesses 22A and 22B are formed in the first side 18 of the first linking member 10 The u-shaped recesses 22A and 22B define an axis 24 The recesses extend from a top side 26 to a bottom side 28 of the first linking member 10. A centerline distance CD between the pair of recesses 22A and 22B may range from about 30 millimeters (mm) to about 130 mm. Each of the recesses 22A and 22B has a first diameter D1 that is slightly larger than an outside diameter of tubing for a folding chair front leg and a second diameter D2 that is substantially the same as the outside diameter of the tubing of the folding chair front leg so that the first linking member 10 can be snappingly engaged with the front leg of the folding chair as described in more detail below.

The first linking member 10 also contains a first slit 30A on the first end 14 thereof and a second slit 30B on the second end 16 thereof. The slits 30A and 30B have a length that extends part way from the bottom side 28 to the top side 26 of the first linking member 10. The width W of the slits 30A and 30B may range from about 5 mm to about 20 mm and so as to engage a cross-member between the front legs of the folding chair.

The first linking member 10 may have a solid body 12, or as shown in FIG. 3 may be a blow-molded or injection-molded structure having reinforcing webs 32 for a generally hollow body 12.

The second linking member 40 is illustrated in FIGS. 4 and 5. Like the first linking member 10, the second linking member 40 has a generally rectangular prism-shaped body 42 having a first side 44 and a second side 46. A first pair of spaced-apart, u-shaped recesses 48A and 48B are formed in the first side 44 of the second linking member 40. The u-shaped recesses 48A and 48B define a first axis 50. The recesses 48A and 48B extend from a top side 52 to the second side 46 of the second linking member 40. A centerline distance CD between the pair of recesses 48A and 48B is the same as the centerline distance CD for the first linking member and likewise may range from about 30 mm to about 130 mm. As with the first linking member 10, each of the recesses 48A and 48B has a first diameter D1 (FIG. 5) that is slightly larger than the outside diameter of the tubing for the folding chair front leg and a second diameter D2 (FIG. 5) that is substantially the same as the outside diameter of the tubing of the folding chair front leg so that the second linking member 40 can be snappingly engaged with the front leg of the folding chair.

The second linking member 40 also contains a second pair of spaced-apart u-shaped recesses 54A and 54B that are spaced apart by a second distance CD2 that is greater than the distance CD and may range from about 80 mm to about 190 mm. The second pair of spaced apart u-shaped recesses 54A and 54B are formed in the second side 46 of the body 42 and extend from a third side 56 to the first side 44. A second axis 58 defined by the second pair of spaced apart u-shaped recesses 54A and 54B is orthogonal to the first axis 50. Each of the recesses 54A and 54B has a third diameter D3 that is slightly larger than an outside diameter of the tubing for a folding chair rear leg and a fourth diameter D4 that is substantially the same as the outside diameter of the tubing of the folding chair rear leg so that the second linking member 40 can be snappingly engaged with the rear leg of the folding chair as described in more detail below.

Like the first linking member 10, the second linking member 40 may also have a solid body 42, or as shown in FIG. 5 may be a blow-molded or injection-molded structure having reinforcing webs 60 for a generally hollow body 42.

The third linking member 70 is illustrated in FIGS. 6 and 7 and has a generally rectangular prism-shaped body 72 having a first side 74 and a second side 76. A pair of spaced-apart, u-shaped recesses 78A and 78B are formed in the first side 74 of the third linking member 70. The recesses 78A and 78B extend from a top side 80 to a bottom side 82 of the third linking member 70. A centerline distance CD2 between the pair of recesses 78A and 78B is the same as the centerline distance CD2 of the second linking member 40. Each of the recesses 78A and 78B has a first diameter D3 that is slightly larger than an outside diameter of the tubing for a folding chair rear leg and a second diameter D4 that substantially the same as the outside diameter of the tubing of the folding chair rear leg so that the third linking member 70 can be snappingly engaged with the rear leg of the folding chair as described in more detail below.

Like the first and second linking members 10 and 40, the third linking member 70 may also have a solid body 72, or as shown in FIGS. 6 and 7 may be a blow-molded or injection-molded structure having reinforcing webs 84 for a generally hollow body 72.

With reference now to FIGS. 8-12, the placement and use of the first, second and third linking members 10, 40 and 70 are illustrated for use in securing connecting folding chairs 100 to one another. Each of the folding chairs 100 has tubular support members that include a lower front leg portion 102, an upper front leg portion 104, an upper rear leg portion 106 and a lower rear leg portion 108. Each of the chairs 100 also includes a seat 114 supported in part by the rear legs 106-108, and a backrest 116 attached to tubular members 102-104 providing the front legs.

Figure 9:
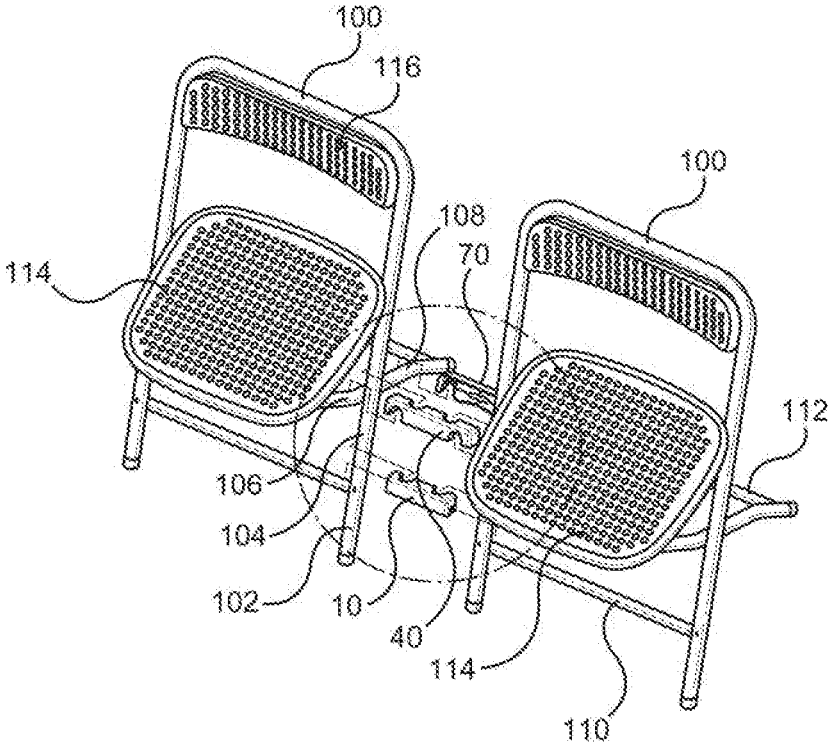
FIG. 9 is a perspective view, not to scale, of the attachment of the linking system according to the disclosure to two folding chairs.
Figure 10:
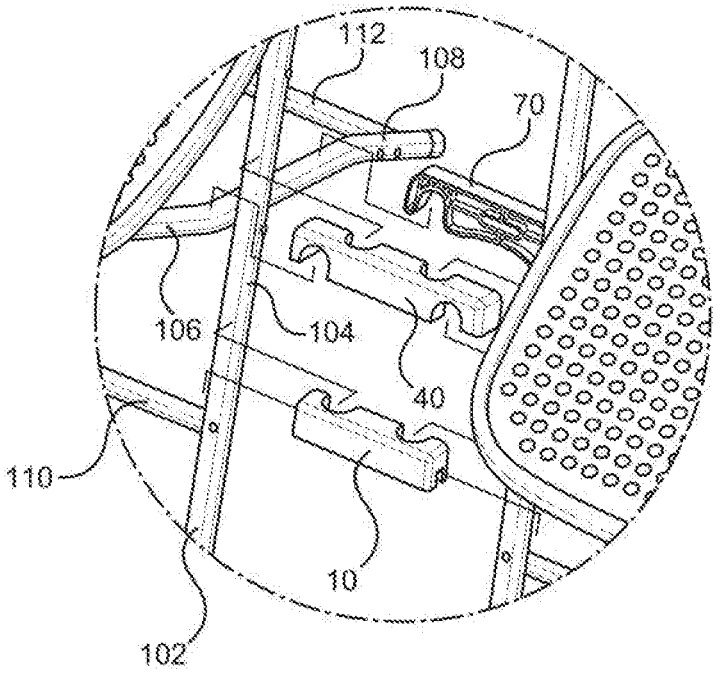
FIG. 10 is a close up perspective view, not to scale, showing how the linking system is attached to tubing members of the folding chairs.

FIGS. 9-10 are perspective views of chairs 100 that illustrate the placement of the first, second and third linking members 10, 40 and 70 between two chairs 100. As shown, the first linking member 10 is snapped on the lower front leg 102 and the slits 30A-30B are slipped over the front leg support 110 of each chair 100. The second linking member 40 is snapped onto the upper front leg 104 and the upper rear leg 106 on both chairs 100. The third linking member 70 is snapped onto the lower rear leg 108 of both chairs to form the linked chairs 100 shown in FIGS. 11 and 12.

Figure 11:
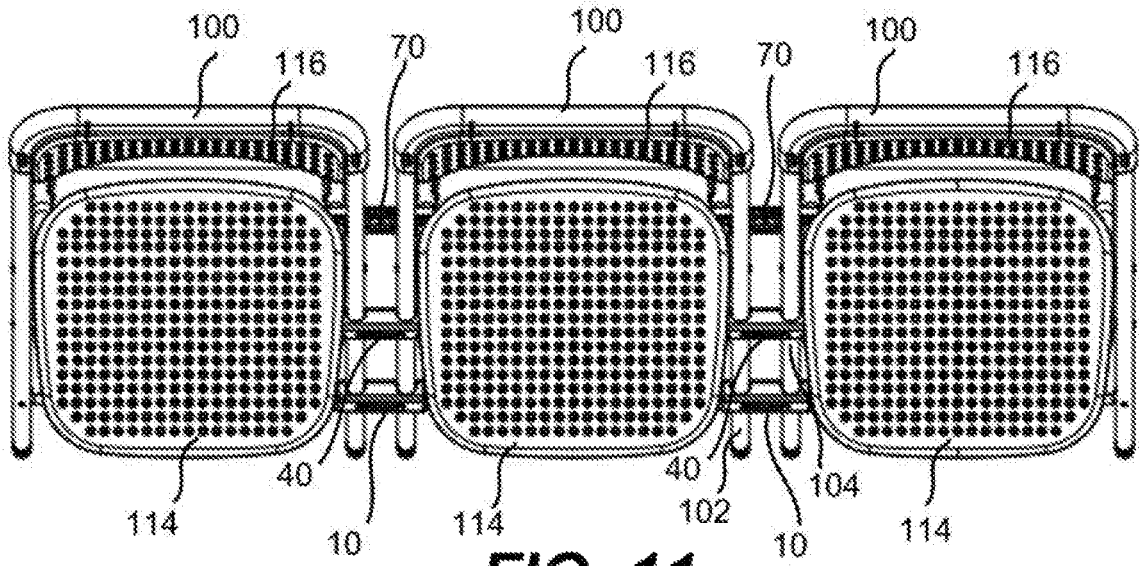
FIG. 11 is a top plan view, not to scale, of folding chairs linked by the linking system of the disclosure.
Figure 12:
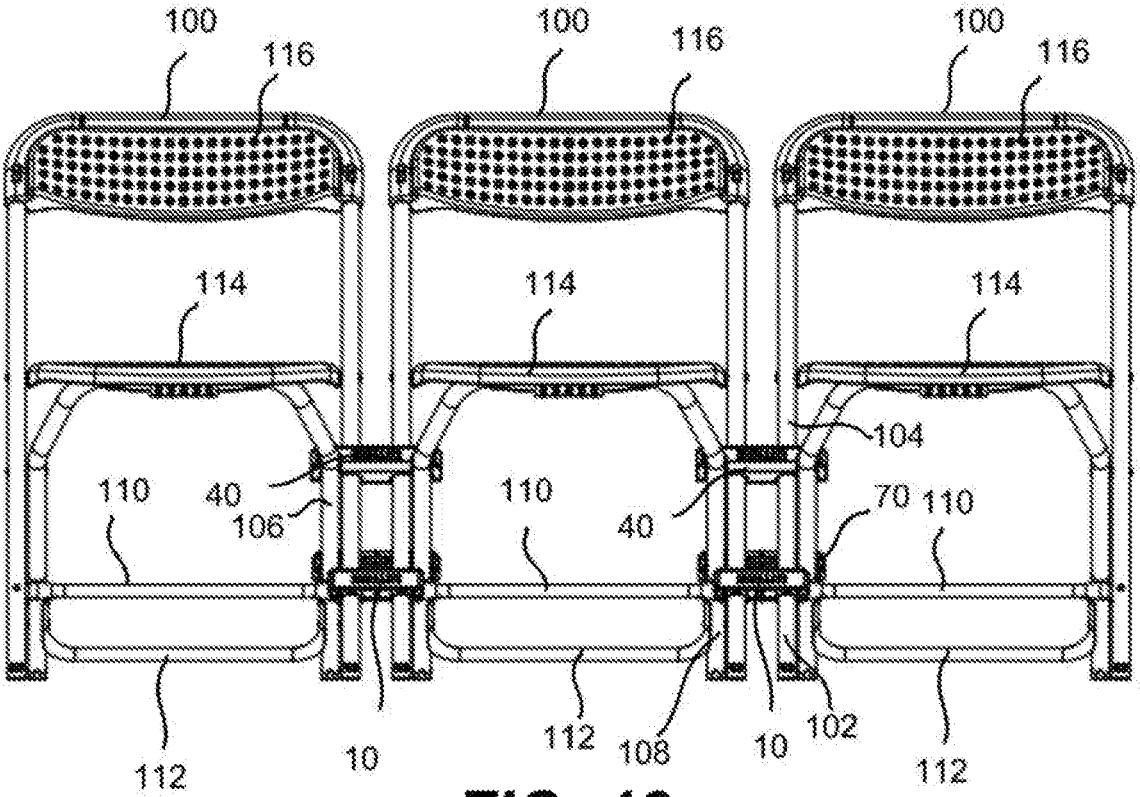
FIG. 12 is a front elevational view, not to scale, of the folding chairs of FIG. 11.

Three chairs 100 are shown linked together in FIGS. 11 and 12. FIG. 11 is a top plan view of three linked chairs 100 and FIG. 12 is a front elevational view of the three linked chairs of FIG. 11. The linking system of the present disclosure is sufficiently robust that up to 10 or more chairs can be linked together in a row so that a force of 200 Newtons on a center chair 100 in a row of chairs will cause any of the chairs 100 in a row of linked chairs to be displaced no more than 200 millimeters from a starting position for the chairs.

In the embodiments described herein, the front and rear legs and support members of each chair may be made of relatively strong metal tubing such as steel or aluminum. The seat 114 and backrest 116 of each chair may be made from common, low-cost natural or synthetic materials, such as wood, plastic, polypropylene, polyethylene, nylon or equivalent polymeric materials. Each of the seat 114 and backrest 116 may be padded or unpadded.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claimed invention.

What is claimed is:

1. A linking system for folding chairs comprising:

a first linking member having two spaced-apart, u-shaped first recesses on a first side thereof and a slit on each end thereof;

a second linking member having two spaced-apart, u-shaped second recesses on a second side thereof and two spaced-apart, u-shaped third recesses on a third side thereof, wherein the u-shaped third recesses are spaced further apart than the second recesses; and a third linking member having two spaced-apart, u-shaped fourth recesses on a fourth side thereof, wherein the first, second and third linking members are configured to snappingly engage tubular members of adjacent folding chairs.

2. The linking system of claim 1, wherein the first linking member is configured to snappingly engage lower front legs and cross-members of two adjacent folding chairs.

3. The linking system of claim 1, wherein the second linking member is configured to snappingly engage upper rear legs and back support members of two adjacent folding chairs.

4. The linking system of claim 1, wherein the third linking member is configured to snappingly engage lower rear legs of two adjacent folding chairs.

5. The linking system of claim 1, wherein the first, second and third linking members are molded from a thermoplastic material.

6. The linking system of claim 5, wherein the first, second and third linking members further comprise reinforcing webbing for strength.

7. The linking system of claim 1, wherein each slit in the first linking member is parallel to an axis defined by the u-shaped recesses.

8. The linking system of claim 1, wherein the third side of the second linking member is orthogonal to the second side.

9. A method for linking folding chairs in rows comprising:

providing a linking system consisting essentially of:

a first linking member having two spaced-apart, u-shaped first recesses on a first side thereof and a slit on each end thereof;

a second linking member having two spaced-apart, u-shaped second recesses on a second side thereof and two spaced-apart, u-shaped third recesses on a third side thereof, wherein the u-shaped third recesses are spaced further apart than the second recesses and the third side is orthogonal to the second side; and a third linking member having two spaced-apart, u-shaped fourth recesses on a fourth side thereof, wherein the first, second and third linking members are configured to snappingly engage tubular members of adjacent folding chairs;

attaching the linking system to tubular members of adjacent folding chairs to provide a row of linked folding chairs.

10. The method of claim 9, wherein the first linking member is configured to snappingly engage lower front legs and cross-members of two adjacent folding chairs.

11. The method of claim 9, wherein the second linking member is configured to snappingly engage upper rear legs and back support members of two adjacent folding chairs.

12. The method of claim 9, wherein the third linking member is configured to snappingly engage lower rear legs of two adjacent folding chairs.

13. The method of claim 9, wherein the first, second and third linking members are molded from a thermoplastic material.

14. The method of claim 13, wherein the first, second and third linking members further comprise reinforcing webbing for strength.

15. The method of claim 9, wherein each slit in the first linking member is parallel to an axis defined by the u-shaped recesses.

16. The method of claim 9, wherein the third side of the second linking member is orthogonal to the second side.

17. A linking system for folding chairs comprising:

a first linking member having two spaced-apart, u-shaped first recesses on a first side thereof and a slit on each end thereof, wherein the first linking member is configured to snappingly engage lower front legs and cross-members of two adjacent folding chairs;

a second linking member having two spaced-apart, u-shaped second recesses on a second side thereof and two spaced-apart, u-shaped third recesses on a third side thereof, wherein the u-shaped third recesses are spaced further apart than the second recesses, wherein the second linking member is configured to snappingly engage upper rear legs and back support members of the two adjacent folding chairs; and a third linking member having two spaced-apart, u-shaped fourth recesses on a fourth side thereof, wherein the third linking member is configured to snappingly engage lower rear legs of two adjacent folding chairs.

18. The linking system of claim 17, wherein each slit in the first linking member is parallel to an axis defined by the u-shaped recesses.

19. The linking system of claim 17, wherein the third side of the second linking member is orthogonal to the second side.

* * * * *